US008381812B2

(12) United States Patent
Sørensen et al.

(10) Patent No.: US 8,381,812 B2
(45) Date of Patent: Feb. 26, 2013

(54) BARRIER FOR INSTRUMENTATION PIPING

(75) Inventors: Per Hassel Sørensen, Sandnes (NO); Gunnar Hviding, Stavanger (NO)

(73) Assignee: Roxar Flow Measurement AS, Bergen (NO)

( * ) Notice: Subject to any disclaimer, the term of this patent is extended or adjusted under 35 U.S.C. 154(b) by 543 days.

(21) Appl. No.: 12/596,915

(22) PCT Filed: Apr. 22, 2008

(86) PCT No.: PCT/NO2008/000145
§ 371 (c)(1),
(2), (4) Date: Oct. 21, 2009

(87) PCT Pub. No.: WO2008/133527
PCT Pub. Date: Nov. 6, 2008

(65) Prior Publication Data

US 2010/0132953 A1 Jun. 3, 2010

(30) Foreign Application Priority Data

Apr. 25, 2007 (NO) ..... 20072150

(51) Int. Cl.
*E21B 47/10* (2006.01)

(52) U.S. Cl. ..... 166/250.08; 166/88.4

(58) Field of Classification Search ..... 166/85.4, 166/250.08, 379, 88.4; 277/330, 324; 439/191, 439/194, 195
See application file for complete search history.

(56) References Cited

U.S. PATENT DOCUMENTS

| | | | | |
|---|---|---|---|---|
| 3,027,903 | A * | 4/1962 | Thorp, Jr. | 137/68.13 |
| 3,379,405 | A * | 4/1968 | Natho | 251/31 |
| 5,667,009 | A | 9/1997 | Moore | |
| 5,706,893 | A * | 1/1998 | Morgan | 166/86.1 |
| 7,069,988 | B2 | 7/2006 | Bartlett et al. | |
| 7,552,765 | B2 * | 6/2009 | Lam | 166/85.4 |
| 2003/0150620 | A1 * | 8/2003 | DeBerry et al. | 166/368 |
| 2003/0196792 | A1 | 10/2003 | Riddell et al. | |
| 2007/0137866 | A1 * | 6/2007 | Ravensbergen et al. | 166/384 |

FOREIGN PATENT DOCUMENTS

EP 0 637 675 2/1995

OTHER PUBLICATIONS

International Search Report for PCT/NO2008/000145, mailed Nov. 28, 2008.
Norwegian Search Report for Norway Application No. 2007 2150, dated Nov. 24, 2007.

* cited by examiner

*Primary Examiner* — David Andrews
*Assistant Examiner* — Kipp Wallace
(74) *Attorney, Agent, or Firm* — Nixon & Vanderhye P.C.

(57) ABSTRACT

A well head barrier assembly (1, 2, 3) including a termination of an instrument tube (9) installed in a well and a primary pressure barrier (3) for the well pressure comprising a tool (10) arranged for being pushed into a passage (5) in which the instrument tube (9) is arranged. The closing of the passage (5) provides an additional secondary pressure barrier in the well head, thus enabling re-establishment of a double pressure barrier following a breakage of the instrument tube (9).

7 Claims, 4 Drawing Sheets

BARRIER FOR INSTRUMENTATION PIPING

This application is the U.S. national phase of International Application No.

PCT/NO2008/000145 filed 22 Apr. 2008, which designated the U.S. and claims priority to Norway Application No. 2007 2150 filed 25 Apr. 2007, the entire contents of each of which are hereby incorporated by reference.

TECHNICAL FIELD OF THE INVENTION

The present invention is related to providing an arrangement for supplying electric power/signals, optical signals, and/or hydraulic power via a sealed well head and into a downhole well, for example a well for the exploitation of subsurface hydrocarbon resources.

More particularly the invention is related to well head barriers that act as electrical and/or optical signal pass through for downhole measuring systems and as a pressure barrier for wells with pressurized fluids and gases.

In such applications unintended leakages of hydrocarbon gases and other liquids/gases in relation to the exploitation of these resources are highly undesirable as such leakages may constitute a significant explosion or fire risk. Thus, electric, optic and/or hydraulic cables in downhole applications are typically enclosed in a sealed metal tube like arrangement for providing a first barrier towards leakages, and where the well head barrier provides a secondary seal, in case the downhole metal tube sealing leaks.

BACKGROUND OF THE INVENTION

In oil and gas wells there are now an increasing tendency to install downhole equipment for control and monitoring of a production flow and/or well conditions, in particular in order to provide better information on the downhole conditions in well systems of increasing complexity. Some downhole equipment is installed for being used over a longer period of time and requires permanent connections into the well. Such connections are required for the transfer of necessary electrical, optical and/or hydraulic signals to the downhole equipment. For electrical and optical signals the connection is typically designed as a relatively thin instrument tube using corrosion resistant metal which protects the electrical and/or optical connections arranged inside the instrument tube, cemented in a filler material. When transmitting hydraulic signals the same type of instrument pipe is used, however without any filler in order that the void can be used to transfer pressure via hydraulic fluid which fills the instrument tube.

Many oil- and gas wells are operating under such a high pressure that breakage or leakage in the part of the instrument tube which is inside the well may occur, resulting in pressure propagating through the instrument pipe, even if the instrument pipe is filled with conductors and filler material. In gas wells, in particular, the pressure will propagate inside the instrument pipe all the way up to the surface. For this reason it is normal to specify the use of a dedicated pressure barrier for the possibility of well pressure inside the instrument tube. Such a barrier will be placed at the end/termination of an instrument tube/pipe, typically as part of a well head barrier assembly.

A well head barrier can be used as signal connector for routing electrical/optical/-hydraulic signal through a well head. Downhole devices, such as downhole mounted sensors, are typically connected to cables running from a downhole location, and inside the well tube to a cable terminating location at the end of the well tube, in a so-called well head.

A pressure barrier for a hydraulic signal typically consists of a valve which manually or automatically closes the well pressure upon a possible breakage of the instrument tube inside the well. A pressure barrier for an electrical or optical signal may be a so-called penetrator and consists of one or more signal conductors which are made pressure tight. This can be done by sealing or encapsulating the optical or electrical conductors in a pressure tight filler material.

By arranging such a pressure barrier for the instrument tube at the well head two barriers are achieved, one consisting of the instrument tube itself and one in the pressure barrier. As known for a person skilled in the art, there are problems and challenges regarding leaks at full well pressure in an instrument tube. However, the well head barrier assembly according to the present invention removes this risk, which increases the safety of the well regarding for instance explosion or fire risk. At a possible breakage of the instrument tube inside the well, a leakage will be stopped before a leakage to the outer environment has occurred.

The disadvantage of a breakage of the instrument pipe is that after the breakage there will be full well pressure at the well head and there is a single pressure barrier separating the well pressure from the environment. If a breakage has occurred in a production pipe in an oil and gas well, the pressure can be controlled by pumping high density drilling fluid into the well. However, present solutions for optical/electrical/hydraulic pressure barriers for downhole equipment does not include a possibility for balancing the pressure inside the instrument tube.

The Objective Of The Invention

It is thus an object of the present solution to provide a device which is capable of increasing the safety of wells in which a breakage or leakage in the downhole instrument tube is possible.

SHORT SUMMARY OF THE INVENTION

According to the invention there is in a first aspect provided a well head barrier assembly having a passage for allocating an instrument tube or pipe. The well head barrier assembly is adapted by sealing the well head in order to provide a primary pressure barrier for the well pressure. Normally, the instrument tube or pipe will also be sealed, thus providing a secondary pressure barrier. A passage closing device is arranged to be able to close a cable passage in said well head barrier assembly to provide the possibility for an auxiliary secondary pressure barrier in the well head barrier assembly, in the event of the failure (leakage or breakage) of the instrument pipe. The auxiliary secondary pressure barrier effectively sets up a pressure barrier between well and an external environment, after the closing device has been changed to its sealing or closing position. Thus, the well head barrier assembly removes the risk for leak at full well pressure, which increases the safety of the well regarding for instance explosion or fire risk.

In a preferable embodiment of the well head barrier assembly according to the invention it comprises a termination of an instrument tube installed in a well and a primary pressure barrier for the well pressure, characterized by a tool arranged for being pushed into a passage in which the instrument tube is arranged, whereby said closing of said passage provides an additional secondary pressure barrier in the well head, thus enabling re-establishment of a double pressure barrier following a breakage of the instrument tube.

In yet a preferable embodiment of the well head barrier assembly according to the invention, said tool is arranged to be able to seal said passage after being pushed into the passage.

In still a preferable embodiment of the well head barrier assembly according to the invention a wall of said passage for allocating said instrument tube is provided with a weakened section, said weakened section typically being substantially thinner than other sections of the passage wall.

In still yet a preferable embodiment of the well head barrier assembly according to the invention, said weakened section is designed to have sufficient strength in an unbroken state to be able to withstand a typical well pressure.

In a further preferable embodiment of the well head barrier assembly according to the present invention, said weakened section is designed so that the tool can break the weakened section and penetrate into the passage.

In a still further preferable embodiment of the well head barrier assembly according to the present invention it comprises pressure testing means for enabling pressure testing of the coupling between the tool and the well barrier.

In a further preferable embodiment of the well head barrier assembly according to the present invention, it comprises a pressure coupling for opening a pressures coupling between the tool and the well barrier.

In still yet a preferable embodiment of the well head barrier assembly according to the present invention, it comprises pressure supplying means, pressure sensing means, and a pressure calculating means for estimating whether the tool is sealed against the well pressure.

In second aspect of the invention there is provided a method for enabling re-establishment of a double pressure barrier in a well in the event of breakage in an instrument tube of the well, the method comprises first the step of providing a well with a well head barrier assembly having a tool capable of sealing a passage for allocating an instrument tube. The tool is used in a second step of the method to seal the passage following the occurrence of a leakage or breakage of the instrument tube, thereby re-establishing a double pressure barrier.

In a preferable embodiment of the method for enabling re-establishment of a double pressure barrier in a well in the event of breakage in an instrument tube of the well according to the present invention, it comprises to provide a well with a well head barrier assembly having a tool capable of sealing a passage for allocating an instrument tube, and to use the tool to seal the passage following the occurrence of a leakage or breakage of the instrument tube, thereby re-establishing a double pressure barrier.

DRAWINGS

The invention will now be described in more detail with references to the appended drawings wherein FIG. 1 illustrates a basic principle of one embodiment of a well head barrier assembly according to the invention.

DETAILED DESCRIPTION OF THE INVENTION

Figure 1:
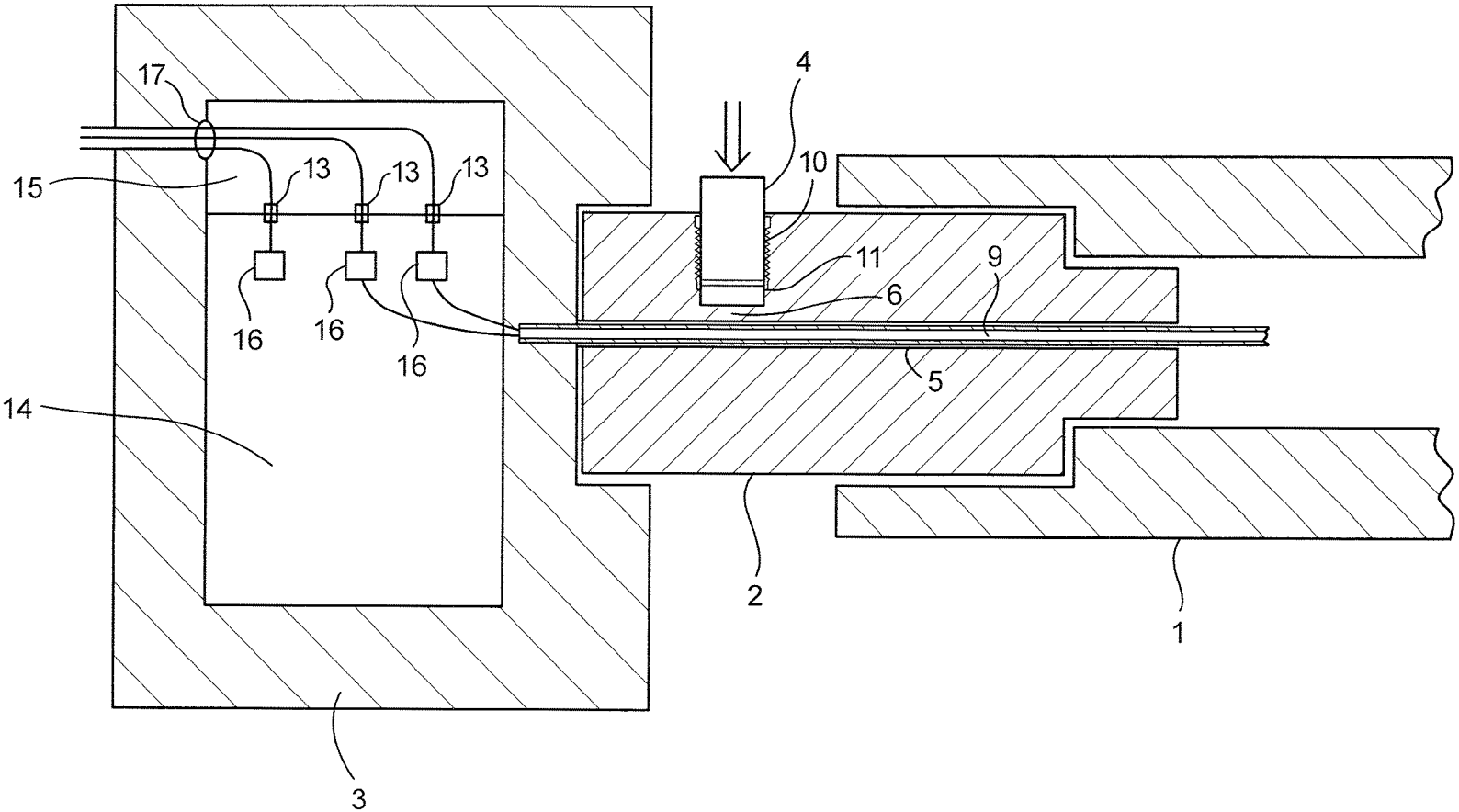

Referring to FIG. 1-FIG. 5, there is shown a well head adapter 1 which is designed to provide a termination of a well. A well head joint 2 is fastened to the well head adapter 1 by e.g. screwing the well head joint 2 into a threaded receiving part of the well head adapter 1. A well head barrier 3 is then fastened to the well head joint 2, e.g. by bolting. An instrument cable conduit 5 runs through the well head joint 2. Inside the conduit 5 an instrument cable 9 can be arranged in order to be able to connect downhole well equipment with other equipment, such as for example surface equipment. The instrument cable 9 may comprise any number of electrical conductors 7 for conducting electric power and/or electric signals as well as any number of optical fibers for conducting optical signals, limited only by the physical dimensions of the cable and or instrument tube or pipe 9. Even though the instrument cable passage or conduit 5 is normally filled with a filler material, which can be an encapsulating or potting material, the instrument cable conduit 5 will typically not be pressure tight but will leak well pressure through to the internal volume of the well head barrier 3 in the case of a leakage in the instrument cable 9. Thus a downhole leakage in the instrument cable 9 is typically passed into a high pressure (HP) volume 14 of the well head barrier 3. The electric and/or optic conductors of the instrument cable 9 are normally terminated at suitable termination points in the HP-part of the well head barrier 3. For transferring signals out of the well head barrier 3 penetrators 13 are arranged between the HP-part of the well head barrier 3 and a low pressure (LP) volume 15 of the barrier. Penetrators 13 are used to allow the passage of connections, whether electric and/or fiber optic, from the termination points 16 in the HP-part 14 of the well head barrier 3 and to the LP-part 15 of the well head barrier. From the LP-part of the well head barrier 3 the electric conductors and/or fiber optic lines can continue to an external supervising unit via standard leadthroughs 17, as there is normally not a large pressure differential between the LP-part 15 and the surrounding environment.

For a situation that a leakage has occurred in the instrument cable 5, a passage closing device 4 for closing a cable passage in said well head barrier assembly 1, 2, 3 can be used to create an additional secondary pressure barrier in the well head barrier assembly 1, 2, 3 between the well and an the external environment when the closing device 4 is in its closed position.

A weakened section 6 of the wall of the conduit 5 is provided by providing an external inwardly directed void 20 which can be filled by a plug 11 being part of a tool 10. The threads of the void 20 and the plug 11 are designed to match each other. Said plug 11 is adapted to be pushable or movable inwardly towards a part of the conduit 5 by said tool 10. The weakened section 6 is designed so as to have sufficient strength to be able to withstand typical internal well pressures, while at the same time be weakened to such an extent that the tool 10 will be able to push through the weakened section 6 and to seal a section of the passage or conduit 5. The weakened section 6 is designed to be substantially thinner than the rest of the wall of the conduit 5, typically a couple of millimeters. The thickness of the wall must be able to withstand well pressure and no mechanical load. Provided the plug 11 is wider than the corresponding internal width of the cable conduit 5, the plug 11 can by screwing the screw 4 forcefully fill up the space inside the instrument cable conduit 5 completely, thereby creating a pressure tight seal between the downhole well and the well head pressure barrier 3. The weakened section 6 can be realized as a pressure tight seal which is able to withstand the typical pressure levels inside the well, and which can be broken by the action of the tool 10. After the weakened section 6 has been broken a pressure tight coupling can be established between the tool 10 and the cable conduit 5 by forcing the tool 10 into the passage/conduit 5. Before the weakened section 6 has been broken, the tightness of the weakened section 6 or seal can be pressure tested by providing the tool 10 with a pressure supplying means and a pressure sensing means. This pressure test is performed to verify that there is no leakage between the well head joint 2 and the pressure coupling on the tool 10 before breaking the weakened section 6. This is important because a possible leakage between the well head joint 2 and the tool 10/void 20 must be repaired before the plug 11 is pushed into the well head joint 2. Further, when an additional pressure barrier has been established by closing the cable conduit 5 using the tool 10, the well pressure against the penetrator(s) 13 in the pressure barrier 3 can, if desirable, be relieved, either temporarily for opening up the pressure barrier 3 for service or on a more permanent basis if it is desirable to reuse parts of the pressure barrier 3, and it is considered safe enough to leave the system with a single pressure barrier generated by the tool 10. The tool 10 could be provided with a pressure coupling between the well pressure and external equipment, such as for example a high pressure pump, in order that a pressure balancing fluid may be pumped into the instrument cable 9 in order to stabilize the well pressure.

Figure 3:
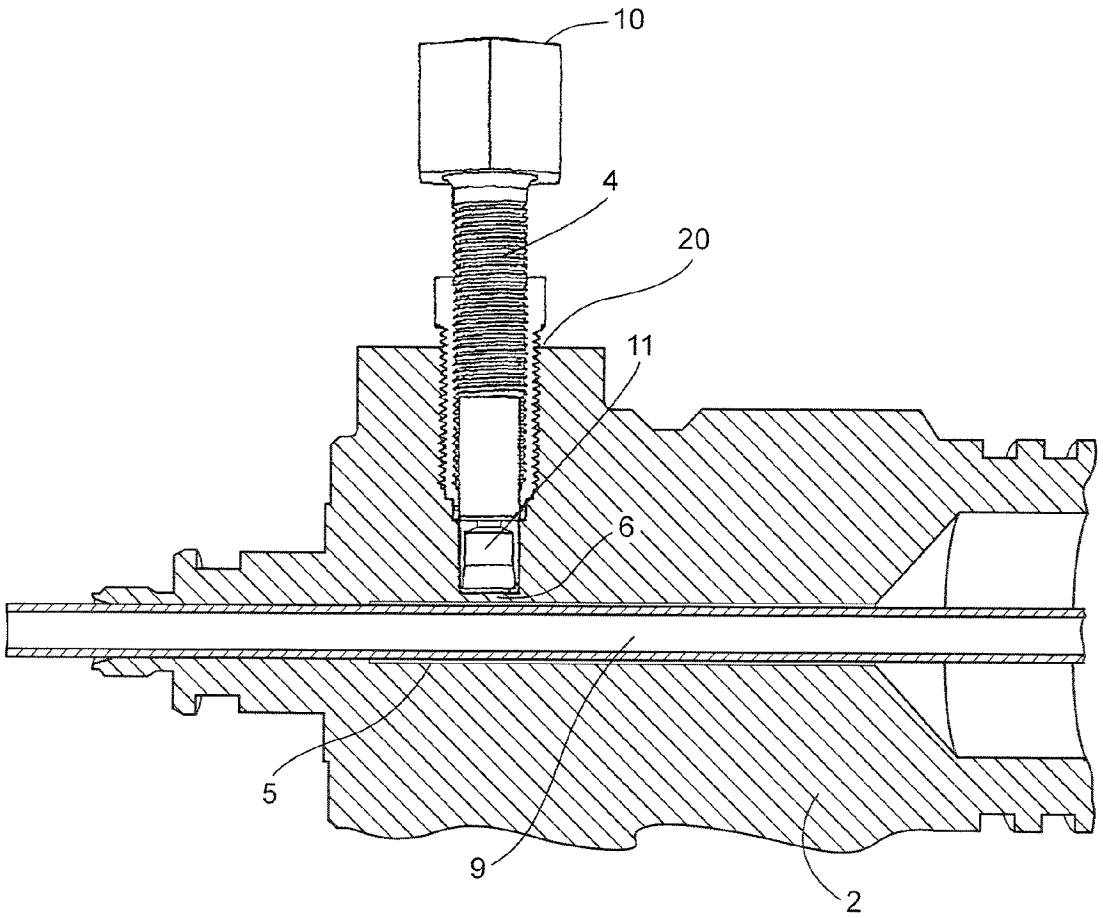
FIG. 3 is an enlarged cross sectional view of a section of FIG. 2
Figure 5:
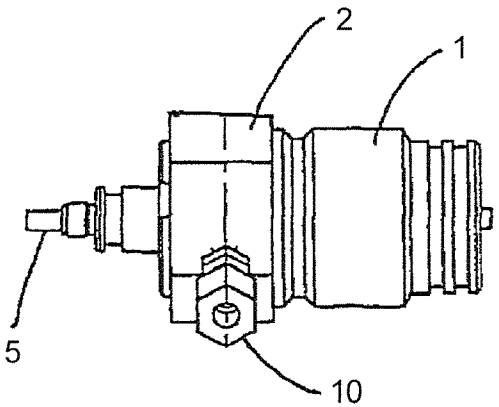
FIG. 5 is a three dimensional view of the well head barrier assembly according to the invention.
Figure 4:
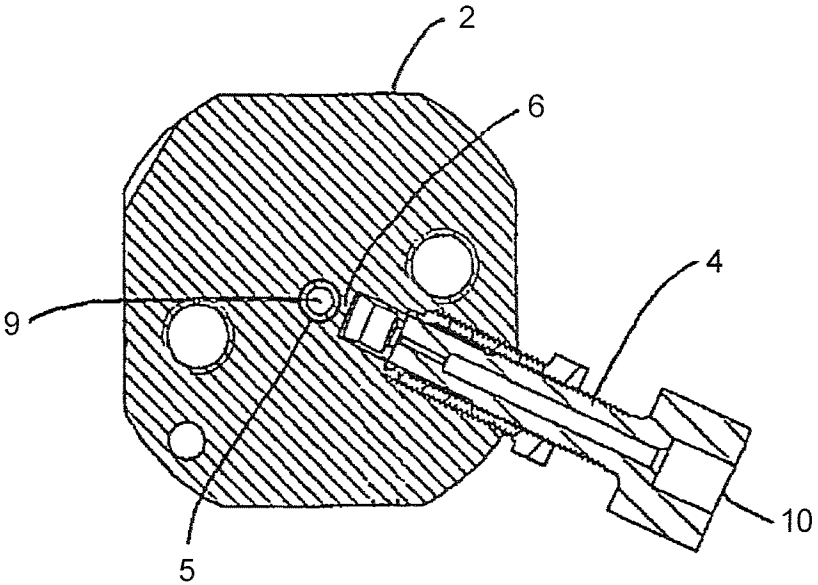
FIG. 4 is a side view of the well head barrier assembly according to the invention.

Initially, the void 20 is screwed into the well head joint 2 while the plug 11 is in the position as shown in FIG. 3. Secondly, the pressure test is performed. Finally, the tool 10 is screwed into the well head joint 2, thus pressing the plug 11 into the well head joint 2 and the instrument pipe 9.

Figure 2:
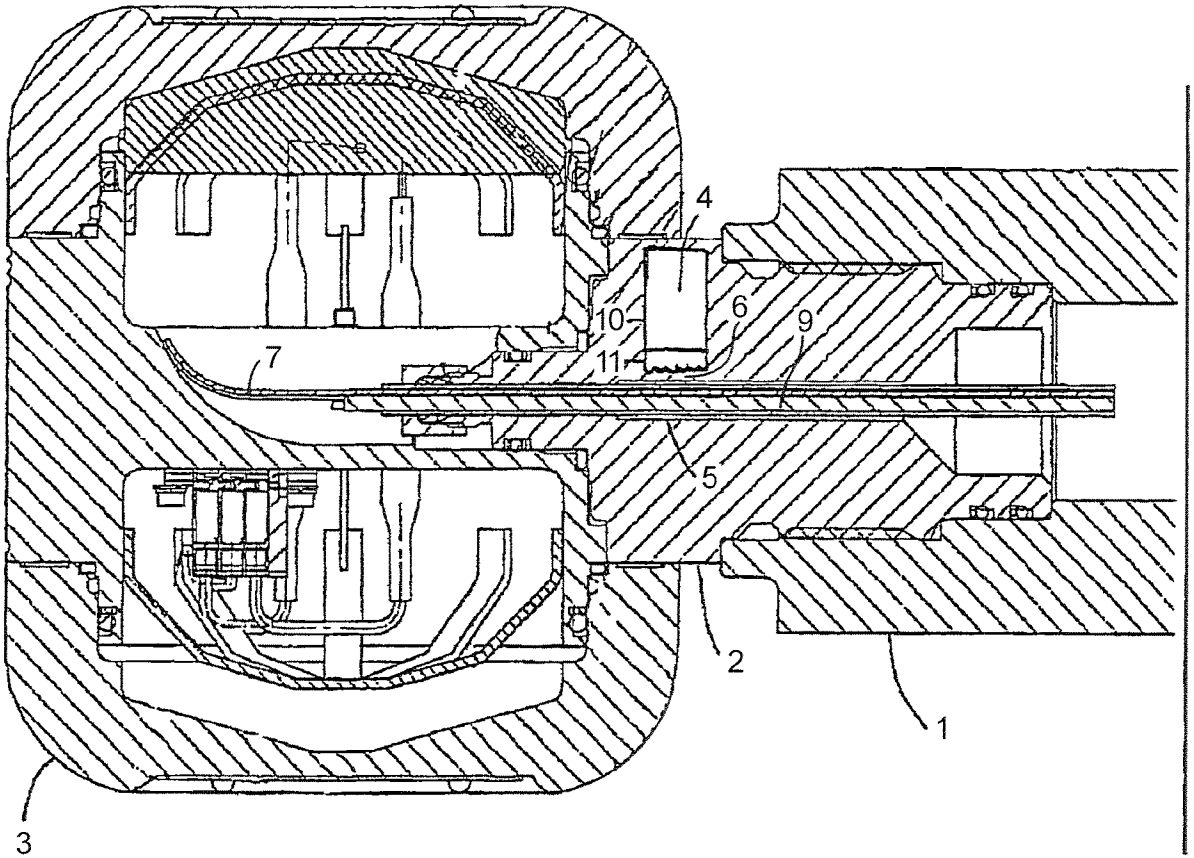
FIG. 2 illustrates a more detailed cross sectional view of a well head barrier assembly according to the invention.

The instrument pipe/tube 9 has typically an outer diameter of 6, 35 mm. In FIG. 2 the pressure barrier 3 is shown in a cross section plan that goes through the center of two lids of the pressure barrier 3. The lids have a diameter of approximately 140 mm about a vertical axe. The height of the assembly is typically 150 mm. The plug 11 has an outer diameter that is slightly larger than the conduit 5, and must be made of a substantially hard material that is able to cut through the well head joint 2 and the instrument pipe 9. Such a material can e.g. be a wolfram carbide alloy. The tool 10 is typically made in a corrosion resistant material, e.g. duplex steel or equivalent.

The activation of the tool 10 for increasing the safeguard against undesirable leakages to the environment in the above described embodiment of the invention is provided at the expense of effectively breaking an electrical or fiber optical communication line in the instrument cable 9, thus rendering measurement and communication with downhole instruments or sensors inoperable. In many situations this tradeoff will be a sensible tradeoff, as increased safety is of primary concern following the failure of one of the barriers in an initial two barrier solution.

In a second aspect of the invention there is provided a method for enabling re-establishment of a double pressure harrier in a well in the event of breakage in an instrument tube 9 of said well. In a first step according to the method there is provided a well head barrier assembly 1, 2, 3 on a well, said assembly 1, 2, 3 including a tool 10 capable of sealing a passage 5 for allocating an instrument tube 9. In second step said tool 10 is used to seal said passage 5 following the occurrence of a leakage or breakage of said instrument tube 9, thereby re-establishing a double pressure barrier.

In summary, the invention provides a pressure tight seal between a tool 10 and a passage 5 to be closed or sealed. There is also provided a coupling between the tool 10 and the passage 5 which may be pressure tested. The pressure tight seal between the tool 10 and the passage 5 can be broken by activation of the tool 10. Following the breakage of the seal between the tool 10 and the passage 5, the tool 10 is pushed into the passage 5, effectively sealing off one section of the passage 5 coupled to the well head barrier 3 and a second end of the passage 5 coupled to the well pressure. Thus, the well pressure against the penetrators 13 of the well head barrier 3 is relieved. A pressure tight coupling is established with the instrument tube or pipe 9 via the tool 10. By connecting the tool 10 to a high pressure pump, a pressure balancing fluid can be pumped into the instrument tube or pipe 9 in order to stabilize the well pressure present in the instrument tube or pipe 9 following a leakage or breakage in this pipe or tube 9.

The main application of the well head barrier assembly 1, 2, 3 and accompanying method according to the invention is in connection with instrument cables 9 for downhole equipment for oil- and gas wells, but it can be envisaged that the invention could also find application in other pressurized oil and gas production or refinery installations.

In one embodiment of the device and method according to the invention, the tool 10 is not supplied with the well head barrier assembly 1, 2, 3 as installed. The well head barrier assembly 1, 2, 3 is adapted to be able to receive the tool 10 as a separate unit, and the tool 10 is provided, as required, on the site of the well head barrier assembly 1, 2, 3 after installation of the well head barrier assembly 1, 2, 3, either by manual handling by a human operator or by some form of a vehicle, for example a remote operated vehicle.

The present invention provides an improvement to the operation of a well head barrier assembly 1, 2, 3 in acting as a confirmed secure second pressure barrier in the event that well pressure is caused to enter the inside of the instrument cable 9, and reduces the risks of explosion or fire related to unintended leakages of hydrocarbon gases and other liquids/gases in relation to the exploitation of these resources. The well head barrier assembly 1, 2, 3 according to the invention can in one alternative embodiment be designed as an Ex-enclosure for potentially explosive atmospheres.

The invention claimed is:

1. A well head barrier assembly comprising:

a well head barrier;

a well head joint between the well head barrier and a well head adapter, the well head joint having an internal passage extending between the well head adapter and the well head barrier;

an instrument tube in the passage of the well head joint and extending into an internal chamber of the well head barrier;

a primary pressure barrier formed by the instrument tube, the well head joint and the well head barrier;

a tool configured to advance through a wall of the well head joint towards and into the passage, whereby advancing of the tool into the passage and against the instrument tube closes said passage and the instrument tube to provide a secondary pressure barrier, and the wall with the passage and to said well head joint includes a weakened section between an advancing end of the tool and the passage, wherein the weakened section is substantially thinner than any other section of the wall.

2. The well head barrier assembly according to claim 1, wherein said tool is arranged to seal said passage after being pushed into said passage.

3. The well head barrier assembly according to claim 1, wherein said weakened section has sufficient strength in an unbroken state to withstand a predetermined level of operational pressure.

4. The well head barrier assembly according to claim 1, wherein said weakened section is sufficiently weak so that said tool can break the weakened section and penetrate into said passage.

5. The well head barrier assembly according to claim 1, further comprising a pressure testing means for enabling pressure testing of the coupling between said tool and said well barrier.

6. The well head barrier assembly according to claim 1, further comprising a pressure coupling for opening a pressure coupling between said tool and the well barrier.

7. The well head barrier assembly according to claim 1, further comprising a pressure calculating means for estimating whether the tool is sealed against the well pressure.

* * * * *